US006434860B1

(12) United States Patent
Turos

(10) Patent No.: US 6,434,860 B1
(45) **Date of Patent: *Aug. 20, 2002**

(54) REMOVABLY MOUNTABLE CLEAT

(75) Inventor: Kenneth Turos, Albuquerque, NM (US)

(73) Assignee: Sun Standard, Inc., Albuquerque, NM (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/161,071

(22) Filed: Sep. 25, 1998

(51) Int. Cl.[7] ..... A43C 15/02
(52) U.S. Cl. ..... 36/134; 36/67 D; 36/59 A
(58) Field of Search ..... 36/67 D, 59 A, 36/127, 134

(56) References Cited

U.S. PATENT DOCUMENTS

| | | | | |
|---|---|---|---|---|
| 925,638 A | * | 6/1909 | Kerr | |
| 1,390,165 A | * | 9/1921 | Sadler | |
| 1,931,186 A | * | 10/1933 | Franzinelli | |
| 2,564,802 A | * | 8/1951 | Coleman et al. | |
| 3,561,140 A | * | 2/1971 | Ludwig | |
| 5,029,405 A | * | 7/1991 | DeHaitre | |
| 5,259,129 A | | 11/1993 | Deacon et al. | 36/127 |
| 5,321,901 A | | 6/1994 | Kelly | 36/134 |
| 5,351,422 A | | 10/1994 | Fitzgerald | 36/134 |
| 5,361,518 A | | 11/1994 | Sussmann et al. | 36/134 |
| 5,367,793 A | | 11/1994 | Deacon et al. | 36/127 |
| 5,386,651 A | | 2/1995 | Okamoto | 36/134 |
| 5,410,823 A | | 5/1995 | Iyoob | 36/127 |
| 5,475,937 A | | 12/1995 | Korsen | 36/134 |
| 5,505,012 A | | 4/1996 | Walker et al. | 36/134 |
| 5,524,367 A | | 6/1996 | Ferreira et al. | 36/134 |
| 5,526,589 A | | 6/1996 | Jordan | 36/134 |
| 5,572,807 A | | 11/1996 | Kelly et al. | 36/127 |
| 5,617,652 A | | 4/1997 | Müller | 36/134 |
| 5,617,653 A | | 4/1997 | Walker | 36/134 |
| 5,623,774 A | | 4/1997 | Abbey | 36/134 |
| 5,638,615 A | | 6/1997 | Korsen | 36/134 |
| 5,655,317 A | | 8/1997 | Grant | 36/134 |
| 5,727,340 A | | 3/1998 | Suk | 36/134 |
| 5,732,484 A | | 3/1998 | Grutza et al. | 36/127 |
| 5,782,017 A | * | 7/1998 | Ortscheid | |
| 5,901,472 A | * | 5/1999 | Adam | |
| 5,992,059 A | * | 11/1999 | Bettenga et al. | |

FOREIGN PATENT DOCUMENTS

| | | | |
|---|---|---|---|
| GB | 10307 | * | 3/1904 |

* cited by examiner

*Primary Examiner*—Ted Kavanaugh
(74) *Attorney, Agent, or Firm*—Ray R. Regan

(57) ABSTRACT

A removably mountable cleat. The cleat includes a plate. One end of a shaft is connected to the plate. The shaft may be connected substantially to the center of the plate. The other end of the shaft is formed with threads for removably mounting the cleat on footwear. The plate and shaft are inserted into a mold containing a compressively yieldable elastomeric material which forms a body around the plate and the shaft. The elastomeric body also is formed with a lower surface that comes in contact with turf or other facilities and equipment associated with a sport and athletic activity. The lower surface of the elastomeric body that may be in contact with turf or other facilities and equipment associated with a sport and athletic activity is formed to include one or more concentric annular rings. The lower surface of the elastomeric body also is formed with a hemispherical chamber within the smallest of the concentric annular rings. The elastomeric body also includes one or more tubular lumens into which a key may be inserted for removing the cleat from the footwear.

12 Claims, 4 Drawing Sheets

REMOVABLY MOUNTABLE CLEAT

CROSS-REFERENCE TO RELATED APPLICATION

None.

FEDERALLY SPONSORED RESEARCH AND DEVELOPMENT

None.

FIELD OF THE INVENTION

The present invention pertains generally to traction devices for footwear. More particularly, the present invention pertains to a cleat removably mountable on footwear for providing stability to a user while not causing damage to sporting facilities and improvements the cleat contacts during use of the cleat. The present invention is particularly, but not exclusively, useful in providing traction and stability during golfing while not causing damage to turf, fairways, putting greens, or facilities and equipment used in connection with golf.

BACKGROUND OF THE INVENTION

Footwear employing naillike metal projections, protuberances of various composite materials, and similar extensions (collectively but not exclusively, "spikes"), are used extensively on athletic footwear for hiking, rock and mountain climbing, golf, American football, soccer, fly fishing, and other activities. One or more spikes may be installed on footwear to provide or enhance traction during use. Footwear equipped with spikes, however, may cause damage not only to athletic and sporting facilities, improvements, and playing surfaces, but also to other equipment used in association with athletic and sporting activities. For example, spikes used on footwear associated with the sport of golf cause unacceptable damage not only to the turf, fairways, and putting greens on which golf is played, but also to equipment and facilities associated with that sport. Conventional spikes used in connection with golf provide little traction on cart trails, board walks, club house floors, carts, and related facilities and equipment.

A problem to be solved is to provide a cleat that is easily mountable on and removable from footwear, that provides stability and traction during the sporting activity, while minimizing damage to facilities, equipment and surfaces used in connection with the footwear. Because of varying foot shapes, different footwear shapes, different weather and topographical conditions, and different forces applied to a cleat during use, a cleat may wear, deteriorate, and change shape (collectively, "wear") differently than another cleat. Another problem to be solved, therefore, is to provide a cleat that may be readily and quickly replaced with a replacement cleat due to differing wear patterns after being mounted on footwear and used.

What is needed is a cleat that may be readily and relatively quickly mounted on and removed from footwear, a cleat that provides stability and traction during use, while causing minimal or no damage to the athletic facilities, playing surfaces and equipment associated with a sport such as golf, including turf, fairways, putting greens, and associated equipment and facilities associated with golf.

In light of the above, it is an object of the present invention to provide a cleat removably mountable on footwear. Additionally, a cleat should be individually replaceable due to different wear patterns on the cleat during use. It is another object of the present invention to provide a removably mountable cleat that provides stability to a user during use. Yet another object of the present invention is to provide a removably mountable cleat that minimizes or precludes damage to facilities on which the sport is conducted and to equipment and facilities used in connection with the sport. The removably mountable cleat also should be relatively quickly and easily mounted on and removed from footwear. Another object of the present invention is to provide a removably mountable cleat that is easy to use and to practice, and which is cost effective for its intended purposes.

These and other objects, features, and advantages of such a removably mountable cleat will become apparent to those skilled in the art when read in conjunction with the accompanying following detailed description, drawing figures, and appended claims.

SUMMARY OF THE INVENTION

A removably mountable cleat, according to the present invention, includes a plate. The plate may be formed in any geometric shape. Two or more alignment grooves are formed in the peripheral edge of the plate. In an embodiment of the plate having two alignment grooves, each groove is disposed substantially opposite the other groove, or 18° apart. In an embodiment of the plate having three or more alignment grooves, each alignment groove is disposed substantially radially equidistant from every other alignment groove. An alignment groove allows a key to be placed against an alignment groove to remove a cleat from footwear. A cleat may be mounted on footwear using finger pressure or torsion; no tool is needed to mount a cleat on footwear.

The plate of the present invention also includes a first face and a second face. A shaft is provided with a proximal end and a distal end. The proximal end of the shaft is connected substantially perpendicular to the first face of the plate. The shaft is connected to the plate substantially at the center of the plate. The proximal end of the shaft is connected to the plate, while threads are formed adjacent the distal end of the shaft. The threads adjacent the distal end of the shaft are engageable with threads provided in a receptacle in the footwear. The receptacle usually is in the ground contact plane of a heel or sole of the footwear.

A compressively yieldable elastomeric body is provided for the removably mountable cleat. The elastomeric body is engageable at least with the plate by inserting the plate and proximal end of the shaft into a mold for forming the elastomeric body. The elastomeric body is formed with an upper surface and a lower surface. A collar is peripherally disposed between the upper surface and the lower surface of the elastomeric body. In addition, during the molding process one or more substantially tubular lumens is formed in the elastomeric body. Each lumen has an anterior opening and a posterior opening. The posterior opening of each lumen is adjacent the lower surface of the body. The anterior opening of each lumen is adjacent to one or more alignment grooves in the plate. A key may be inserted through a lumen for contact with an alignment groove for removing the cleat from footwear.

The lower surface of the elastomeric body also is formed with one or more substantially concentric annular rings. In addition, a hemispherical chamber is formed within one of the concentric annular rings having the shortest diameter. The hemispherical chamber is aligned substantially concentric to the longitudinal axis of the shaft. The concentric annular rings, and the hemispherical chamber, combine with the compressively yieldable elastomeric material of the body to provide traction and stability for the user, while causing minimal or no damage to turf, fairways, putting greens, facilities and associated equipment that the cleat may contact.

The foregoing has outlined broadly the more important features of the invention to better understand the detailed description which follows, and to better understand the contribution of the present invention to the art. Before explaining at least one embodiment of the invention in detail, it is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of descriptions and should not be regarded as limiting.

As those skilled in the art will appreciate, the conception on which this disclosure is based may be readily used as a basis for designing other structures, cooperations of structure, methods, and systems for carrying out the purposes of the present invention. The claims, therefore, include such equivalent constructions to the extent the equivalent constructions do not depart from the spirit and scope of the present invention.

The abstract associated with this disclosure is intended neither to define the invention, which is measured by the claims, nor intended to be limiting as to the scope of the invention.

It is an object, therefore, of the present invention to provide a new and improved removably mountable cleat. The novel features of this invention, and the invention itself, both as to structure and operation, are best understood from the accompanying drawing figures, considered in connection with the accompanying description of the drawing figures, in which similar reference characters refer to similar parts, and in which:

DESCRIPTION OF THE PREFERRED EMBODIMENTS

Figure 1:
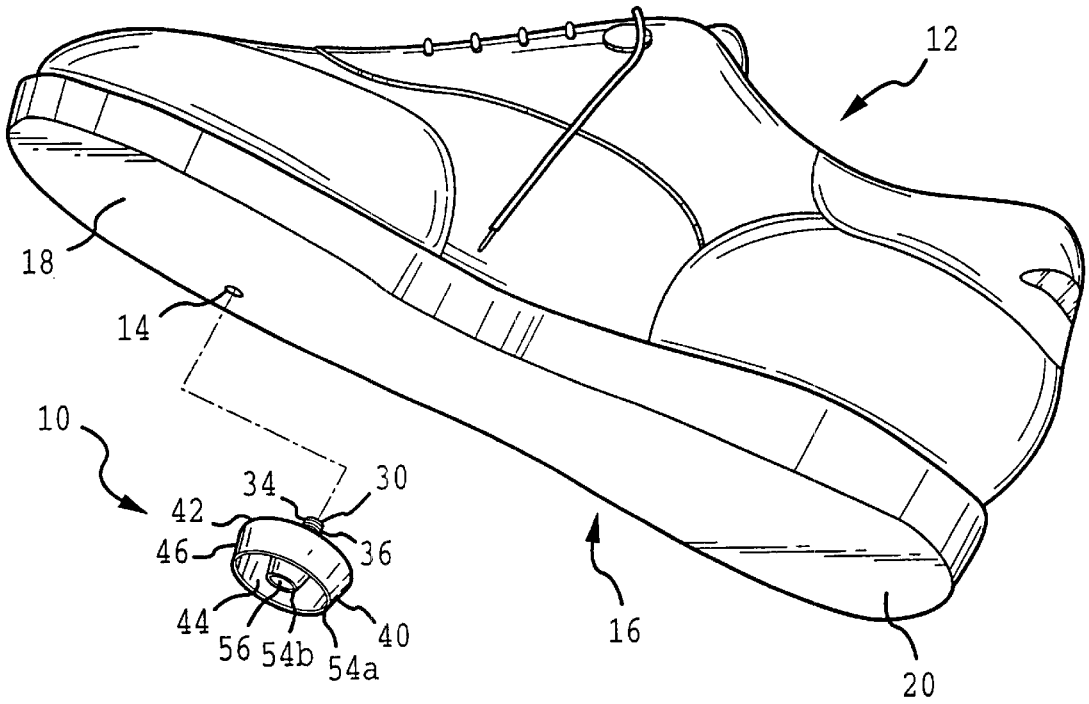
FIG. 1 is a perspective view of a removably mountable cleat in an operative environment showing only one of a possible plurality of receptacles in an example of footwear.
Figure 2:
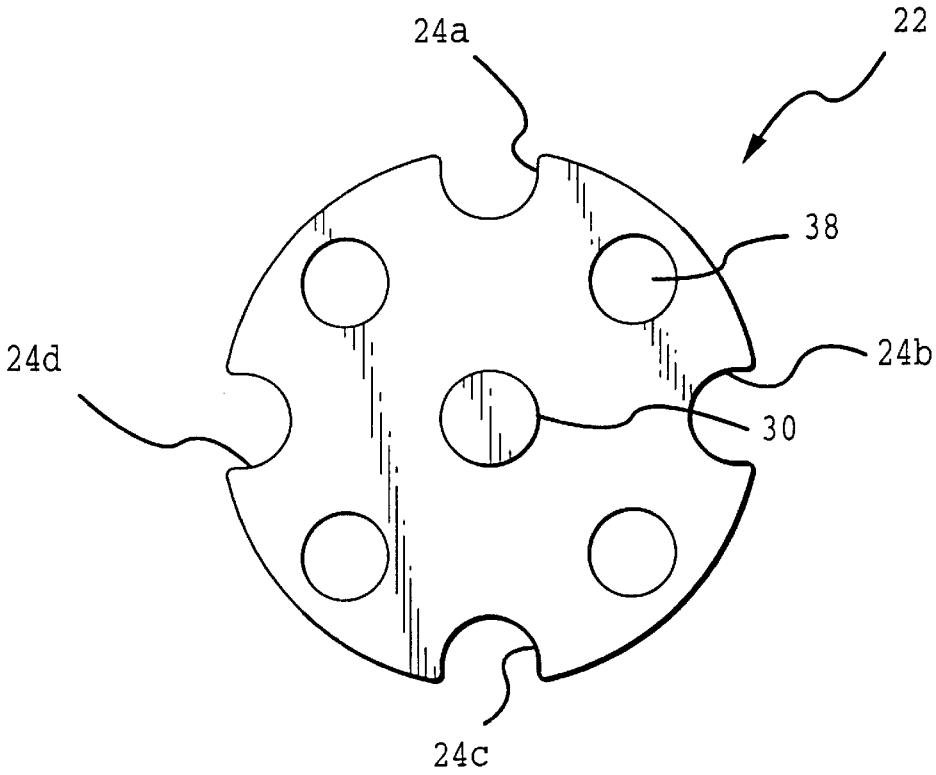
FIG. 2 is a top plan view of a preferred embodiment of the plate of the present invention.

Referring initially to FIG. 1, a removably mountable cleat is shown in an operative embodiment and generally designated 10. FIG. 1 also shows removably mountable cleat 10 may be mounted on footwear 12. FIG. 1 shows that removably mountable cleat 10 may be mounted to footwear 12 by mounting removably mountable cleat 10 on receptacle 14 of footwear 12. Receptacle 14 usually is found on the underside 16 of footwear 12, commonly on the sole 18 or heel 20 of footwear 12. Footwear 12 commonly provides a plurality of receptacles 14 (not shown) for mounting a plurality of removably mountable cleats 10 or other spikes on footwear 12.

As best shown by cross-reference among FIGS. 2 through 5, removably mountable cleat 10 includes a plate 22. The material used to make plate 22 is not significant to the invention. In a preferred embodiment of the present invention, however, plate 22 made from a compound mostly of zinc. As shown best by cross-reference between FIGS. 2 and 3, in a preferred embodiment of removably mountable cleat 10, plate 22 is formed with two or more alignment grooves 24. In a preferred embodiment of plate 22 having four alignment grooves 24*a,b,c* and *d*, each alignment grove 24*a,b,c* and *d* is disposed substantially ninety degrees (90°) apart and substantially radially equidistant from every other alignment groove 24*a,b.c*. Alignment groove 24*a,b,c* and *d*. Alignment groove 24 is formed to accept a key (not shown) to be placed against an alignment groove 24 to remove removably mountable cleat 10 from footwear 12. Removably mountable cleat 10 may be mounted on receptacle 14 of footwear 12 using finger pressure or similar torsion force; no tool is needed to mount removably mountable cleat 10 on footwear 12.

Figure 3:
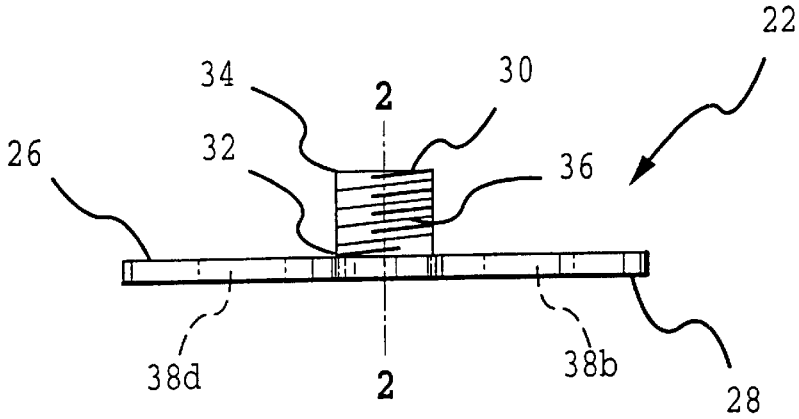
FIG. 3 is a side view of a preferred embodiment of the plate of the present invention.
Figure 4:
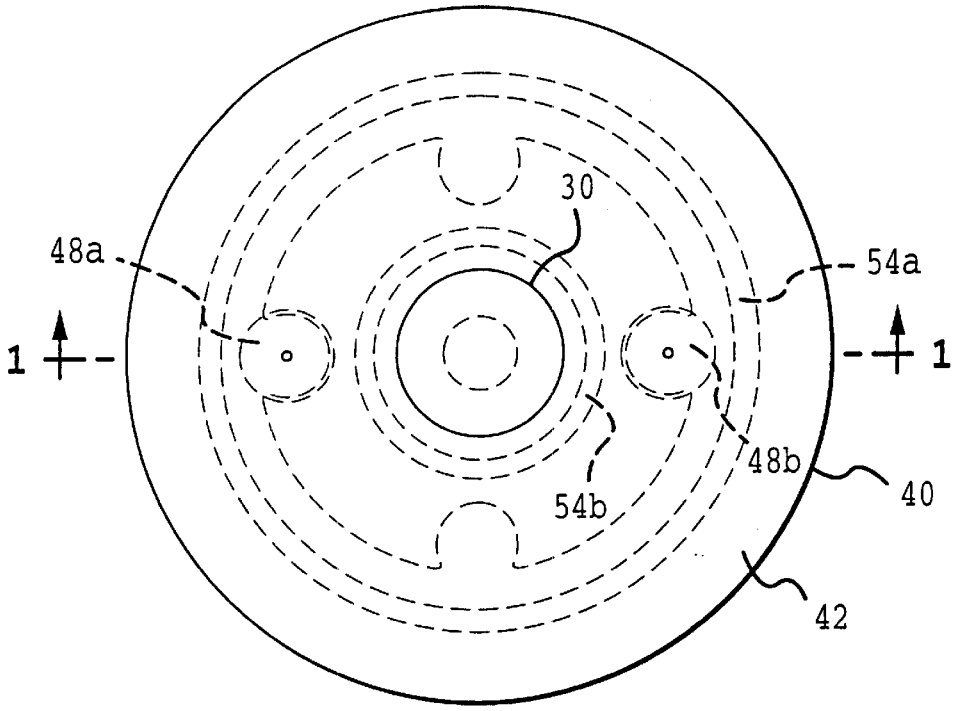
FIG. 4 is top plan view of a preferred embodiment of the present invention.
Figure 5:
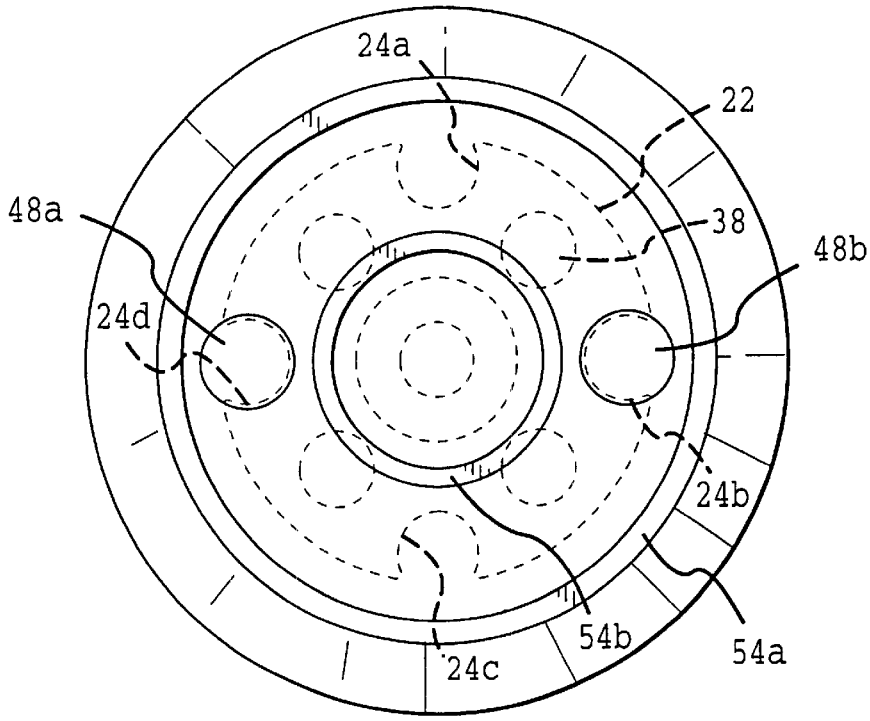
FIG. 5 is bottom plan view of a preferred embodiment of the present invention.

Plate 22 of removably mountable cleat 10, as best shown in FIG. 3, includes a first face 26 of plate 22 and a second face 28 of plate 22. As shown by cross-reference among FIGS. 2 through 6, shaft 30 is connected to plate 22. As best shown in FIG. 3, shaft 30 includes a proximal end 32 and a distal end 34. Proximal end 32 is connected to plate 22. In a preferred embodiment of removably mountable cleat 10, and as best shown by cross-reference between FIGS. 6 and 7, shaft 30 is formed in situ from plate 22. Shaft 30 is substantially perpendicular to vertical axis 2—2 of plate 22 as best shown in FIGS. 3 and 7. As also shown best in FIGS. 3 through 7, proximal end 32 of shaft 30 is connected to plate 22 substantially at the center of plate 22. In a preferred embodiment of removably mountable cleat 10, threads 36 are formed on shaft 30 between distal end 34 of shaft 30 and proximal end 32 of shaft 30, as shown in FIG. 3. Threads 36 are engageable with threads (not shown) in a representative receptacle 14 of footwear 12. As shown best in FIGS. 2 and 3, the preferred embodiment of plate 22 of removably mountable cleat 10 also includes one or more apertures 38. One or more apertures 38, however, are included in plate 22 solely for molding purposes in connection with forming additional elements, as described below, of removably mountable cleat 10.

The material used to make shaft 30 is not critical to the invention. In a preferred embodiment of the present invention, however, plate 22 and shaft 30 are made from a compound mostly of zinc. Construction of plate 22 and shaft 30 from metal currently is preferred because it is common for receptacles on footwear, like receptacle 14 on footwear 12, to be constructed of metal, and engaging metal to metal generally enhances the likelihood of a stronger, tighter grip when mounting removably mountable cleat 10 on receptacle 14 of footwear 12. Further, there is less likelihood of accelerated wear and deformation that arises when dissimilar materials are mounted together. A spike such as removably mountable cleat 10 used in connection with footwear 12 is subjected to significant compressive axial forces during use, as well as torque along and against shaft 30. In addition, demounting removably mountable cleat 10 to and from footwear 12 applies significant rotational and torque stresses on plate 22 and shaft 30. Such forces are increased during inclement weather such as, for example, rain, mud and sleet. The preferred embodiment of removably mountable cleat 10 employs materials to withstand those forces.

As shown best by cross-reference among FIGS. 1, 4, 6 and 7, removably mountable cleat 10 also includes a compressively yieldable elastomeric body 40. Compressively yieldable elastomeric body 40 is engageable at least with plate 22 by inserting plate 22 and shaft 30 into a mold (not shown) for forming compressively yieldable elastomeric body 40. In a preferred embodiment of the present invention the material is a compound of consisting primarily of Nitrile-70 durometer non-marring.

Figure 6:
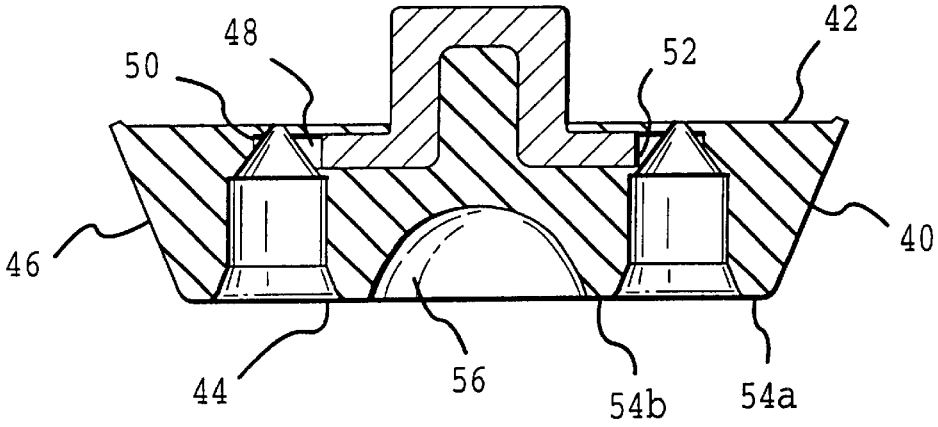
FIG. 6 is a side sectional view along the line 1—1 in FIG. 4 of a preferred embodiment of the resent invention.
Figure 7:
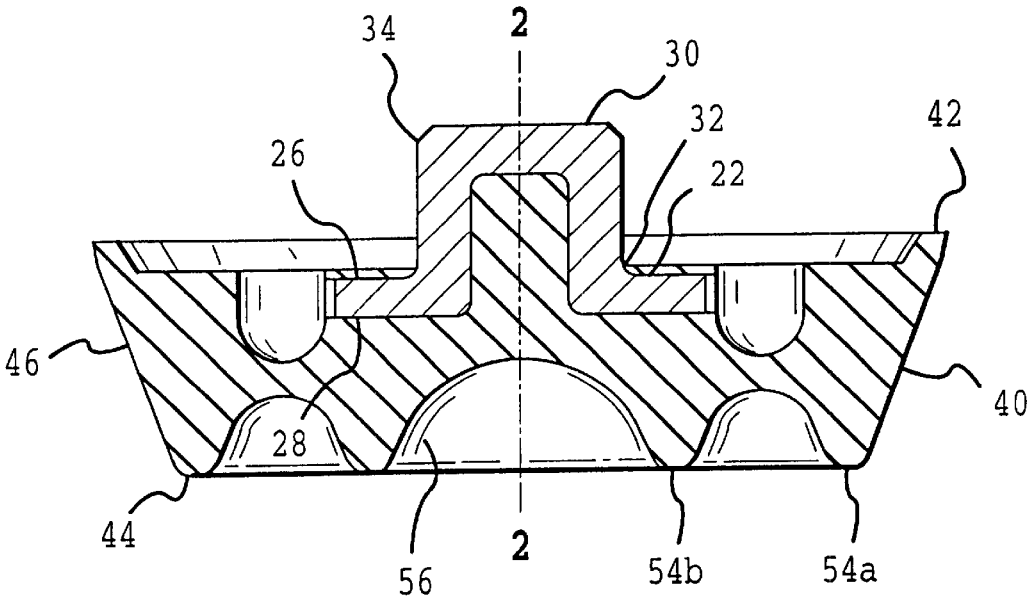
FIG. 7 is a side sectional view along the line 1—1 in FIG. 4 of a preferred embodiment of the present invention.

As shown best in FIGS. 6 and 7, compressively yieldable elastomeric body 40 is formed with an upper surface first side or surface 42 and a lower surface second side or surface 44. In addition, a collar 46 is peripherally disposed between upper surface 42 and lower surface 44 of compressively yieldable elastomeric body 40. In a preferred embodiment of the present invention, as shown best in FIGS. 1, 6 and 7, collar 46 extends inwardly radially between upper surface 42 and lower surface 44 of compressively yieldable elastomeric body 40. The invention, however, is not limited by the described preferred embodiment, and collar 46 may extend outwardly radially between upper surface 42 and lower surface 44, or may extend substantially concentrically between upper surface 42 and lower surface 44 to axis 2—2 through shaft 30 as shown in FIG. 7. In addition, as shown by FIG. 6, compressively yieldable elastomeric body 40 is formed with one or more tubular lumens 48. As shown best in FIG. 6, each of the one or more tubular lumens 48 is formed with an anterior opening 50 and a posterior opening 52. Each of the one or more anterior openings 50 of tubular lumen 48 is adjacent to at least one alignment groove 24 in plate 22. A key (not shown) may be inserted into the one or more lumens 48 until the key makes contact through anterior opening 50 with an alignment groove 24. Pressure may be applied to the key to turn or twist removably mountable cleat 10 to remove removably mountable cleat 10 from receptacle 14 on footwear 12.

Lower surface 44 of compressively yieldable elastomeric body 40 also includes at least one or more substantially concentric annular rings 54, as best shown in FIGS. 1, 6 and 7. In addition, a substantially hemispherical chamber 56 is formed within concentric annular ring **54*b* having the shortest diameter of concentric annular rings 54*a* and 54*b* in the preferred embodiment, as best shown in FIGS. 6 and 7. Concentric annular rings 54*a* and 54*b*, and hemispherical chamber 56, combine with the compressively yieldable elastomeric material of compressively yieldable elastomeric body 40 to provide traction and stability for a user, while causing minimal or no damage to turf, fairways, putting greens, facilities and associated equipment that removably mountable cleat 10** may contact.

While the removably mountable cleat as shown in the accompanying drawing figures is one embodiment of the present invention, it is merely one embodiment of the invention, is not intended to be exclusive, and is not a limitation of the present invention. Additionally, while the particular removably mountable cleat as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

What is claimed is:

1. A cleat removably mountable on a receptacle of footwear, comprising:

a plate:

a threaded shaft extending substantially perpendicularly from a surface of the plate for threadedly engaging the receptacle of the footwear; and a body of compressibly yieldable material disposed about the plate such that the shaft extends out of the body from a first side thereof, wherein the body includes a peripheral, circumferentially extending collar that furthermore projects at a second side of the body in a direction essentially opposite to extension of the shaft from the first side of the body, wherein the second side of the body is furthermore provided with an annular ring that is disposed radially inwardly of, and concentric to, the collar, and wherein the annular ring encircles a hemispherical chamber.

2. A cleat according to claim 1, wherein an outer peripheral surface of the body tapers radially inwardly from the first side to the second side of the body.

3. A cleat according to claim 1, wherein the plate is a having apertures plate, and wherein the body is molded about the plate.

4. A cleat removably mountable on a receptacle of footwear, comprising:

a plate formed with a first face and a second face;

a threaded shaft extending substantially perpendicularly from the first face of the plate for engaging the receptacle of the footwear; and a body engageable with at least the plate, the body formed with a first surface, a second surface, and a circumferentially extending collar disposed between the first surface and the second surface, the second low surface formed with at least one annular ring having a substantially hemispherical chamber with at least one annular ring.

5. A cleat removably mountable on a receptacle of footwear as recited in claim 4, wherein the body is formed of compressibly yieldable material.

6. A cleat removably mountable on a receptacle of footwear as recited in claim 5, wherein the body is formed of elastomeric material.

7. A cleat removably mountable on a receptacle of footwear as recited in claim 6, wherein the shaft is formed in situ from the plate.

8. A cleat removably mountable on a receptacle of footwear as recited in claim 7, further comprising one or more alignment grooves formed in the plate.

9. A cleat removably mountable on a receptacle of footwear as recited in claim 8, wherein the shaft includes a proximal end and a distal end.

10. A cleat removably mountable on a receptacle of footwear as recited in claim 9, wherein the distal end of the shaft includes threads for mounting the cleat on the receptacle.

11. A cleat removably mountable on a receptacle of footwear as recited in claim 10, wherein the body further comprises one or more substantially tubular lumens having an anterior opening and a posterior opening.

12. A cleat removably mountable on a receptacle of footwear as recited in claim 11, wherein the anterior opening of the one or more lumens is adjacent one or more alignment grooves formed in the plate.

* * * * *